US011268369B2

(12) United States Patent
Cuellar et al.

(10) Patent No.: US 11,268,369 B2
(45) **Date of Patent: *Mar. 8, 2022**

(54) SMART SYSTEM FOR SELECTION OF WELLBORE DRILLING FLUID LOSS CIRCULATION MATERIAL

(71) Applicant: Saudi Arabian Oil Company, Dhahran (SA)

(72) Inventors: Hugo Fernando Osorio Cuellar, Dhahran (SA); Rafael M. Pino Rojas, Dhahran (SA); Victor Carlos Costa de Oliveira, Dhahran (SA); Khaled K. Abouelnaaj, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 24 days.

This patent is subject to a terminal disclaimer.

(21) Appl. No.: 16/859,265

(22) Filed: Apr. 27, 2020

(65) Prior Publication Data

US 2020/0256180 A1 Aug. 13, 2020

Related U.S. Application Data

(63) Continuation of application No. 15/961,500, filed on Apr. 24, 2018, now Pat. No. 10,794,170.

(51) Int. Cl.
*E21B 44/00* (2006.01)
*E21B 21/08* (2006.01)
(Continued)

(52) U.S. Cl.
CPC ..... *E21B 44/00* (2013.01); *E21B 21/003* (2013.01); *E21B 21/08* (2013.01); *E21B 45/00* (2013.01); *E21B 21/065* (2013.01)

(58) Field of Classification Search
CPC ..... E21B 21/06; E21B 21/062; E21B 21/063; E21B 21/065; E21B 21/08; E21B 21/003; E21B 2021/007; E21B 21/01
See application file for complete search history.

(56) References Cited

U.S. PATENT DOCUMENTS 1,812,044 A 6/1931 Grant
3,335,801 A 8/1967 Wilsey
(Continued)

FOREIGN PATENT DOCUMENTS

CN 201902206 7/2011
CN 103003519 3/2013
(Continued)

OTHER PUBLICATIONS

GCC Examination Report in GCC Appln. No. GC 2019-37420, dated Oct. 1, 2020, 4 pages.
(Continued)

*Primary Examiner* — Cathleen R Hutchins
(74) *Attorney, Agent, or Firm* — Fish & Richardson P.C.

(57) ABSTRACT

A smart system for circulating LCM can implement a method. While a wellbore is being drilled in a geologic formation, drilling parameters identifying wellbore drilling conditions of a wellbore drilling system drilling the wellbore are received. The wellbore drilling system flows a wellbore drilling fluid including particulates of different size distributions. The particulates operate as LCM to reduce loss of the wellbore drilling fluid in the geologic formation. Size distributions of the particulates in the wellbore drilling fluid flowing through multiple different wellbore fluid flow pathways of the wellbore drilling system are received. The size distributions represent a concentration of the particulates in the wellbore drilling fluid. A release of certain particulates into the wellbore drilling fluid is controlled based, in part, on
(Continued)

the received drilling parameters and the received size distributions of the particulates.

20 Claims, 3 Drawing Sheets

(51) Int. Cl.

| | |
|---|---|
| ***E21B 45/00*** | (2006.01) |
| ***E21B 21/06*** | (2006.01) |
| ***E21B 21/00*** | (2006.01) |

(56) References Cited

U.S. PATENT DOCUMENTS

| | | | |
|---|---|---|---|
| 3,557,875 | A | 1/1971 | Solum et al. |
| 4,058,163 | A | 11/1977 | Yandell |
| 4,384,625 | A | 5/1983 | Roper et al. |
| 4,399,873 | A | 8/1983 | Lindsey, Jr. |
| 4,458,761 | A | 7/1984 | Van Vreeswyk |
| 4,482,014 | A | 11/1984 | Allwin et al. |
| 4,646,842 | A | 3/1987 | Arnold et al. |
| 4,674,569 | A | 6/1987 | Revils et al. |
| 4,681,159 | A | 7/1987 | Allwin et al. |
| 4,693,328 | A | 9/1987 | Furse et al. |
| 4,852,654 | A | 8/1989 | Buckner |
| 4,855,820 | A | 8/1989 | Barbour |
| 4,944,348 | A | 7/1990 | Whiteley et al. |
| 4,993,493 | A | 2/1991 | Arnold |
| 5,152,342 | A | 10/1992 | Rankin et al. |
| 5,390,742 | A | 2/1995 | Dines et al. |
| 5,947,213 | A | 9/1999 | Angle |
| 6,009,948 | A | 1/2000 | Flanders et al. |
| RE36,556 | E | 2/2000 | Smith |
| 6,152,221 | A | 11/2000 | Carmicheal et al. |
| 6,163,257 | A | 12/2000 | Tracy |
| 6,234,250 | B1 | 5/2001 | Green et al. |
| 6,378,628 | B1 | 4/2002 | McGuire et al. |
| 6,527,066 | B1 | 3/2003 | Rives |
| 6,550,534 | B2 | 4/2003 | Brett |
| 6,577,244 | B1 | 6/2003 | Clark et al. |
| 6,662,110 | B1 | 12/2003 | Bargach et al. |
| 6,684,953 | B2 | 2/2004 | Sonnier |
| 6,691,779 | B1 | 2/2004 | Sezginer et al. |
| 6,739,398 | B1 | 5/2004 | Yokley et al. |
| 6,752,216 | B2 | 6/2004 | Coon |
| 6,873,267 | B1 | 3/2005 | Tubel et al. |
| 6,899,178 | B2 | 5/2005 | Tubel |
| 6,938,698 | B2 | 9/2005 | Coronado |
| 7,219,730 | B2 | 5/2007 | Tilton et al. |
| 7,228,902 | B2 | 6/2007 | Oppelt |
| 7,243,735 | B2 | 7/2007 | Koederitz et al. |
| 7,252,152 | B2 | 8/2007 | LoGiudice et al. |
| 7,278,492 | B2 | 10/2007 | Braddick |
| 7,419,001 | B2 | 9/2008 | Broussard |
| 7,581,440 | B2 | 9/2009 | Meek |
| 7,654,334 | B2 | 2/2010 | Manson |
| 7,665,537 | B2 | 2/2010 | Patel et al. |
| 7,677,303 | B2 | 3/2010 | Coronado |
| 7,938,192 | B2 | 5/2011 | Rytlewski |
| 7,940,302 | B2 | 5/2011 | Mehrotra et al. |
| 8,028,767 | B2 | 10/2011 | Radford et al. |
| 8,102,238 | B2 | 1/2012 | Golander et al. |
| 8,191,635 | B2 | 6/2012 | Buske et al. |
| 8,237,585 | B2 | 8/2012 | Zimmerman |
| 8,334,775 | B2 | 12/2012 | Tapp et al. |
| 8,424,605 | B1 | 4/2013 | Schultz et al. |
| 8,448,724 | B2 | 5/2013 | Buske et al. |
| 8,469,084 | B2 | 6/2013 | Clark et al. |
| 8,528,668 | B2 | 9/2013 | Rasheed |
| 8,540,035 | B2 | 9/2013 | Xu et al. |
| 8,750,513 | B2 | 6/2014 | Renkis |
| 8,789,585 | B2 | 7/2014 | Leising et al. |
| 8,800,655 | B1 | 8/2014 | Bailey |
| 8,833,472 | B2 | 9/2014 | Hay |
| 8,919,431 | B2 | 12/2014 | Lott |
| 8,925,213 | B2 | 1/2015 | Sallwasser |
| 8,991,489 | B2 | 3/2015 | Redlinger et al. |
| 9,038,718 | B1 | 5/2015 | Karimi |
| 9,051,792 | B2 | 6/2015 | Herberg et al. |
| 9,091,148 | B2 | 7/2015 | Moffitt et al. |
| 9,121,255 | B2 | 9/2015 | Themig et al. |
| 9,140,100 | B2 | 9/2015 | Daccord et al. |
| 9,157,294 | B2 | 10/2015 | Kleppa et al. |
| 9,187,959 | B2 | 11/2015 | Treviranus et al. |
| 9,208,676 | B2 | 12/2015 | Fadell et al. |
| 9,341,027 | B2 | 5/2016 | Radford et al. |
| 9,494,003 | B1 | 11/2016 | Carr |
| 9,506,318 | B1 | 11/2016 | Brunet |
| 9,546,536 | B2 | 1/2017 | Schultz et al. |
| 2002/0148607 | A1 | 10/2002 | Pabst |
| 2003/0001753 | A1 | 1/2003 | Cernocky et al. |
| 2004/0060741 | A1 | 4/2004 | Shipalesky et al. |
| 2004/0156264 | A1 | 8/2004 | Gardner et al. |
| 2005/0273302 | A1 | 12/2005 | Huang et al. |
| 2006/0081375 | A1 | 4/2006 | Ruttley |
| 2006/0086497 | A1 | 4/2006 | Ohmer et al. |
| 2006/0107061 | A1 | 5/2006 | Holovacs |
| 2006/0260799 | A1 | 11/2006 | Broussard |
| 2006/0290528 | A1 | 12/2006 | MacPherson et al. |
| 2007/0057811 | A1 | 3/2007 | Mehta |
| 2007/0107911 | A1 | 5/2007 | Miller et al. |
| 2007/0187112 | A1 | 8/2007 | Eddison et al. |
| 2007/0261855 | A1 | 11/2007 | Brunet |
| 2008/0041631 | A1 | 2/2008 | Vail, III |
| 2008/0115574 | A1 | 5/2008 | Meek |
| 2009/0045974 | A1 | 2/2009 | Patel |
| 2009/0050333 | A1 | 2/2009 | Smith |
| 2009/0114448 | A1 | 5/2009 | Laird et al. |
| 2009/0188718 | A1* | 7/2009 | Kaageson-Loe ..... E21B 21/003 175/40 |
| 2009/0223670 | A1 | 9/2009 | Snider |
| 2009/0289808 | A1 | 11/2009 | Prammer |
| 2010/0097205 | A1 | 4/2010 | Script |
| 2010/0101786 | A1 | 4/2010 | Lovell et al. |
| 2010/0212891 | A1 | 8/2010 | Stewart et al. |
| 2010/0212900 | A1 | 8/2010 | Eddison et al. |
| 2010/0212901 | A1 | 8/2010 | Buytaert |
| 2010/0258298 | A1 | 10/2010 | Lynde et al. |
| 2010/0282511 | A1 | 11/2010 | Maranuk et al. |
| 2011/0067884 | A1 | 3/2011 | Burleson et al. |
| 2011/0073329 | A1 | 3/2011 | Clemens et al. |
| 2011/0127044 | A1 | 6/2011 | Radford et al. |
| 2011/0147014 | A1 | 6/2011 | Chen et al. |
| 2011/0240302 | A1 | 10/2011 | Coludrovich, III |
| 2011/0266004 | A1 | 11/2011 | Hallundbaek et al. |
| 2012/0085540 | A1 | 4/2012 | Heijnen |
| 2012/0175135 | A1 | 7/2012 | Dyer et al. |
| 2012/0241154 | A1 | 9/2012 | Zhou |
| 2012/0247767 | A1 | 10/2012 | Themig et al. |
| 2012/0307051 | A1 | 12/2012 | Welter |
| 2012/0312560 | A1 | 12/2012 | Bahr et al. |
| 2013/0128697 | A1 | 5/2013 | Contant |
| 2013/0153245 | A1 | 6/2013 | Knobloch et al. |
| 2014/0060844 | A1 | 3/2014 | Barbour et al. |
| 2014/0083769 | A1 | 3/2014 | Moriarty et al. |
| 2014/0090898 | A1 | 4/2014 | Moriarty et al. |
| 2014/0126330 | A1 | 5/2014 | Shampine et al. |
| 2014/0139681 | A1 | 5/2014 | Jones, Jr. et al. |
| 2014/0166367 | A1 | 6/2014 | Campbell et al. |
| 2014/0172306 | A1 | 6/2014 | Brannigan |
| 2014/0208847 | A1 | 7/2014 | Baranov |
| 2014/0308203 | A1 | 10/2014 | Sheinberg et al. |
| 2015/0027706 | A1 | 1/2015 | Symms |
| 2015/0090459 | A1 | 4/2015 | Cain et al. |
| 2015/0152713 | A1 | 6/2015 | Garcia et al. |
| 2015/0176362 | A1 | 6/2015 | Prieto et al. |
| 2015/0267500 | A1 | 9/2015 | Van Dongen et al. |
| 2015/0308203 | A1 | 10/2015 | Lewis |
| 2016/0160578 | A1 | 6/2016 | Lee |
| 2016/0215612 | A1 | 7/2016 | Morrow |
| 2016/0230508 | A1 | 8/2016 | Jensen |
| 2016/0237764 | A1 | 8/2016 | Jellison et al. |
| 2016/0237768 | A1 | 8/2016 | Jamison et al. |
| 2016/0356152 | A1 | 12/2016 | Croux |

(56) References Cited

U.S. PATENT DOCUMENTS

| | | | | |
|---|---|---|---|---|
| 2017/0074071 | A1 | 3/2017 | Tzallas et al. | |
| 2017/0191919 | A1* | 7/2017 | Kulkarni | E21B 21/06 |
| 2018/0030810 | A1 | 2/2018 | Saldanha | |

FOREIGN PATENT DOCUMENTS

| | | |
|---|---|---|
| CN | 204177988 | 2/2015 |
| EP | 377234 | 10/1989 |
| EP | 618345 | 10/1994 |
| EP | 2692982 | 5/2014 |
| EP | 2835493 | 2/2015 |
| GB | 2157743 | 10/1985 |
| GB | 2261238 | 12/1993 |
| GB | 2460096 | 11/2009 |
| GB | 2470762 | 12/2010 |
| WO | 2003058545 | 7/2003 |
| WO | 2011038170 | 3/2011 |
| WO | 2011095600 | 8/2011 |
| WO | 2011159890 | 12/2011 |
| WO | 2016007139 | 1/2016 |

OTHER PUBLICATIONS

International Search Report and Written Opinion issued in International Application No. PCT/US20109/025282 dated Jun. 27, 2019, 13 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

GCC Examination Report in GCC Appln. No. GC 2019-37420, dated Apr. 21, 2020, 5 pages.

CN Office Action in Chinese Appln. No. 201980038207.9, dated Jun. 29, 2021, 16 pages, with English Translation.

* cited by examiner

SMART SYSTEM FOR SELECTION OF WELLBORE DRILLING FLUID LOSS CIRCULATION MATERIAL

CLAIM OF PRIORITY

This application is a Continuation of and claims priority to U.S. patent application Ser. No. 15/961,500, filed on Apr. 24, 2018, of which the entire contents the application is incorporated herein by reference.

TECHNICAL FIELD

This disclosure relates to wellbore drilling.

BACKGROUND

To form a wellbore into a geologic formation, a drill bit pulverizes a path through the geological formation. During the drilling process, drilling fluid is circulated to cool and lubricate the bit, remove the pulverized bits of the formation (also known as "cuttings"), and maintain a static pressure on the reservoir formation. In some instances, during the drilling process, a high loss zone can be encountered. A high loss zone is a zone in which drilling circulation fluid is lost from the wellbore to the geologic formation. Circulation fluid can be expensive and is normally recirculated through the wellbore continuously. When circulation is lost to the geologic formation in the high-loss zone, more circulation fluid is often added at great expense. In addition, the loss of fluid reduces the static pressure on the geologic formation. Such a loss in pressure can result in a "kick", or a pressurized release of hydrocarbons from the wellbore. When a high loss formation is encountered, loss control materials can be added to the drilling circulation fluid to plug the high loss zone. The loss control material is able to plug the high loss zone by becoming lodged within the pores and fractures located in the walls of the wellbore.

SUMMARY

This specification describes technologies relating to smart systems for selection of wellbore drilling fluid loss circulation material.

Certain aspects of the subject matter described in this disclosure can be implemented as a wellbore drilling system. The system includes multiple particulate distribution analyzers (PSDs), a particulates reservoir coupled to the multiple PSDs and a processing system coupled to both. Each PSD is configured to determine a size distribution of particulates in a wellbore drilling fluid circulated through the wellbore drilling system. Each PSD is coupled to a respective wellbore drilling fluid flow pathway. The particulates include lost circulation material (LCM) configured to reduce loss of the wellbore drilling fluid into a geologic formation in which the wellbore is being drilled. The particulates reservoir is configured to carry particulates of different physical properties and to release certain particulates into a drilling fluid tank of the wellbore drilling system to be mixed with the wellbore drilling fluid circulated through the drilling fluid tank. The processing system is configured to perform operations while drilling the wellbore. The processing system receives drilling parameters identifying wellbore drilling conditions of the wellbore drilling system. The processing system receives size distributions of particulates in the wellbore drilling fluid from the multiple PSDs. The processing system controls the particulates reservoir to release the certain particulates into the drilling fluid tank based, in part, on the received drilling parameters and the received size distributions of the particulates.

In certain aspects combinable with any of the other aspects, the multiple PSDs can include three PSDs coupled to three respective wellbore drilling fluid flow pathways. The first pathway is between a drilling fluid pump and a drilling rig. The second pathway is between the drilling rig and a shaker system. The third pathway is between the shaker system and the drilling fluid tank.

In certain aspects combinable with any of the other aspects, the particulates reservoir includes a fine particulates reservoir containing particulates of a first size distribution, a medium particulates reservoir containing particulates of a second size distribution greater than the first size distribution and a coarse particulates reservoir containing particulates of a third size distribution greater than the second size distribution. Each particulates reservoir is coupled to the drilling fluid tank. The first particulates reservoir is configured to release a quantity of the particulates of the first size distribution into the drilling fluid tank in response to a first controlling signal from the processing system. The medium particulates reservoir is configured to release a quantity of the particulates of the second size distribution into the drilling fluid tank in response to a second controlling signal from the processing system. The third particulates reservoir is configured to release a quantity of the particulates of the third size distribution into the drilling fluid tank in response to a third controlling signal from the processing system.

In certain aspects combinable with any of the other aspects, each particulate size distribution analyzer is configured to determine the size distribution of particulates in the wellbore drilling fluid circulated through the respective wellbore drilling fluid flow pathway during wellbore drilling.

In certain aspects combinable with any of the other aspects, a concentration of the particulates in the wellbore drilling fluid decrease during the wellbore drilling operations. The processing system is configured to perform operations including determining, based on the received drilling parameters and the received size distributions of the particulates, a quantity of the particulates to be added to the wellbore drilling fluid to increase the concentration of the particulates to a level sufficient to reduce the loss of the wellbore drilling fluid into a geologic formation in which the wellbore is being drilled.

In certain aspects combinable with any of the other aspects, the processing system is configured to perform operations including periodically providing, as outputs, concentrations of the particulates in the wellbore drilling fluid during the wellbore drilling operations.

In certain aspects combinable with any of the other aspects, the different physical properties of the particulates include a particulate size ranging between 1 micrometer and 2,000 micrometer.

Certain aspects of the subject matter described here can be implemented as a method. While a wellbore is being drilled in a geologic formation, drilling parameters identifying wellbore drilling conditions of a wellbore drilling system drilling the wellbore are received. The wellbore drilling system flows a wellbore drilling fluid including particulates of different size distributions. The particulates operate as LCM to reduce loss of the wellbore drilling fluid in the geologic formation. Size distributions of the particulates in the wellbore drilling fluid flowing through multiple different wellbore fluid flow pathways of the wellbore drilling system are received. The size distributions represent a concentration of the particulates in the wellbore drilling fluid. A release of certain particulates into the wellbore drilling fluid is controlled based, in part, on the received drilling parameters and the received size distributions of the particulates.

In certain aspects combinable with any of the other aspects, the drilling parameters include a rate of penetration of a drill bit, a flow rate of the wellbore drilling fluid through the wellbore, and a rate of loss of the wellbore drilling fluid in the geologic formation in which the wellbore is being drilled.

In certain aspects combinable with any of the other aspects, a concentration of the particulates in the wellbore drilling fluid decreases during the wellbore drilling operations. Based on the received drilling parameters and the received size distributions of the particulates, a quantity of the particulates to be added to the wellbore drilling fluid to increase the concentration of the particulates to a level sufficient to reduce the loss of the wellbore drilling fluid into a geologic formation in which the wellbore is being drilled, is determined.

In certain aspects combinable with any of the other aspects, periodically, concentrations of the particulates in the wellbore drilling fluid are provided as outputs during the wellbore drilling operation.

In certain aspects combinable with any of the other aspects, the certain particulates include one or more of particulates of a first size distribution, particulates of a second size distribution greater than the first size distribution, and particulates of a third size distribution greater than the second size distribution.

Certain aspects of the subject matter described here can be implemented as a wellbore drilling system. A drilling fluid tank is configured to carry wellbore drilling fluid. A wellbore pump is configured to pump the wellbore drilling fluid during a wellbore drilling operation. A wellbore drilling rig is configured to support wellbore drilling equipment configured to drill the wellbore in a geologic formation during the wellbore drilling operation. A shaker system is configured to remove cuttings carried by the wellbore drilling fluid during the wellbore drilling operations. The system includes multiple PSDs, each configured to determine a size distribution of particulates in a wellbore drilling fluid circulated through the wellbore drilling system. Each PSD is coupled to a respective wellbore drilling fluid flow pathway through which the wellbore drilling fluid is flowed. The particulates include LCM configured to reduce loss of the wellbore drilling fluid into the geologic formation in which the wellbore is being drilled. A system is coupled to the multiple PSDs. The processing system is configured to perform operations while drilling the wellbore. The processing system receives drilling parameters identifying wellbore drilling conditions of the wellbore drilling system. The processing system is configured to receive size distributions of particulates in the wellbore drilling fluid from the multiple PSDs. The processing system is configured to release the certain particulates into the drilling fluid tank based, in part, on the received drilling parameters and the received size distributions of the particulates.

In certain aspects, combinable with any of the other aspects, the multiple PSDs can include three PSDs coupled to three respective wellbore drilling fluid flow pathways. The first pathway is between a drilling fluid pump and a drilling rig. The second pathway is between the drilling rig and a shaker system. The third pathway is between the shaker system and the drilling fluid tank.

In certain aspects combinable with any of the other aspects, the particulates reservoir includes a fine particulates reservoir containing particulates of a first size distribution, a medium particulates reservoir containing particulates of a second size distribution greater than the first size distribution and a coarse particulates reservoir containing particulates of a third size distribution greater than the second size distribution. Each particulates reservoir is coupled to the drilling fluid tank. The first particulates reservoir is configured to release a quantity of the particulates of the first size distribution into the drilling fluid tank in response to a first controlling signal from the processing system. The medium particulates reservoir is configured to release a quantity of the particulates of the second size distribution into the drilling fluid tank in response to a second controlling signal from the processing system. The third particulates reservoir is configured to release a quantity of the particulates of the third size distribution into the drilling fluid tank in response to a third controlling signal from the processing system.

In certain aspects combinable with any of the other aspects, each particulate size distribution analyzer is configured to determine the size distribution of particulates in the wellbore drilling fluid circulated through the respective wellbore drilling fluid flow pathway during wellbore drilling.

In certain aspects combinable with any of the other aspects, a concentration of the particulates in the wellbore drilling fluid decrease during the wellbore drilling operations. The processing system is configured to perform operations including determining, based on the received drilling parameters and the received size distributions of the particulates, a quantity of the particulates to be added to the wellbore drilling fluid to increase the concentration of the particulates to a level sufficient to reduce the loss of the wellbore drilling fluid into a geologic formation in which the wellbore is being drilled.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
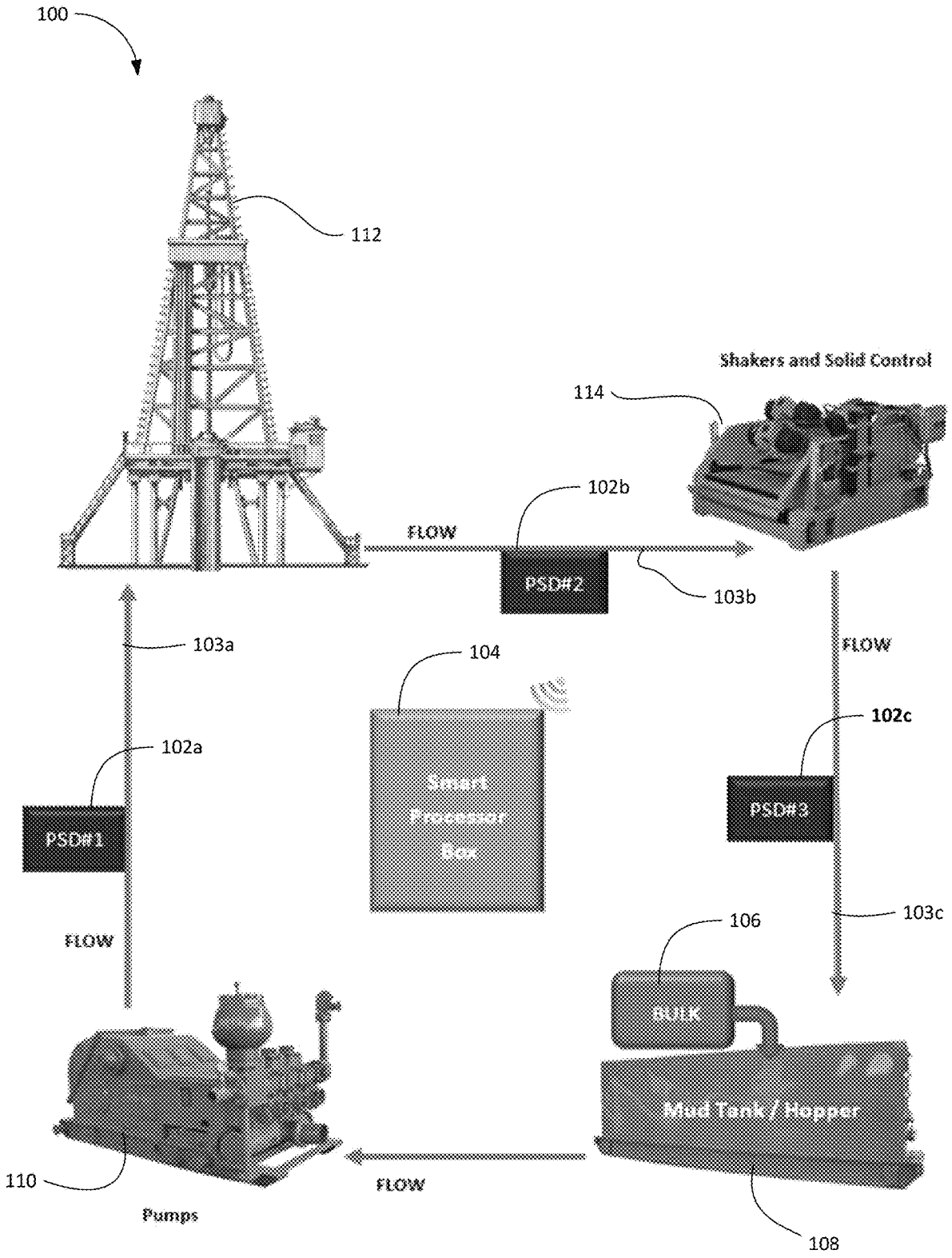
FIG. 1 is a schematic diagram of a wellbore drilling system including a lost circulation monitoring system.

When encountering a high-loss zone, a large volume of drilling fluid can be lost into the geologic formation accompanied by a quick drop of the fluid column within the wellbore. The drop of fluid column can trigger various drilling problems such as stuck pipe, wellbore instability, a kick, or a blowout, all of which can lead to side tracking or abandonment of a well. The possibility of causing various drilling problems increases with increasing delay in controlling the loss of circulation fluid. Loss control materials (LCMs) can be used to mitigate losses of drilling fluid when a high-loss zone is encountered during drilling operations. LCMs can include particulates or hydratable fluids to block off the high-loss zone. Particulates block the high loss zone by becoming trapped within rock-pores and fractures along the wellbore wall through which the drilling fluid passes into the geologic formation. Effective control of the loss of whole fluid requires the deposition of a resilient, stable, and tight seal that can maintain integrity and stability during changing in-situ stress conditions, depleted reservoir conditions, varying tectonic conditions, fluctuating operating conditions under high surge and swabbing pressures, and many other downhole conditions, in order to provide short, as well as long term, control of whole fluid losses. Significant amounts of resilient LCM can often be needed to isolate a high-loss zone. Such large amounts can have significant financial costs.

This disclosure describes a smart and automated system to monitor, in real-time, drilling fluids, specifically, drilling fluids that are flowed out of the wellbore during a drilling operation and treated before being re-circulated into the wellbore. The system includes a central processor (Smart Processor Box) connected to multiple particulate size distribution (PSD #1, PSD #2, PSD #3) subsystems. Each PSD is positioned in a respective drilling fluid flow pathway. Specifically, PSD #1 is in the pathway between the flow pump and the drilling rig, PSD #2 is in the flow pathway between the drilling rig and the shale shakers, and PSD #3 is in the flow pathway between the shale shakers and the mud tank. Each PSD is configured to measure the size distribution of particulates in their respective flow pathways, and to transmit the size distribution to the Smart Processor Box. The Smart Processor Box is also connected to a computer system that provides drilling parameters including a rate of penetration (ROP), flow rate and losses rate. Based on the drilling parameters and the size distributions received from the PSDs, the Smart Processor Box determines drilling fluid treatment parameters to optimize drilling. Drilling fluid treatment includes adding particulates of different sizes to the drilling fluid in the mud tank. The drilling fluid treatment parameters includes the particulate sizes—fine, medium, large—and a quantity of the particulates. The Smart Processor Box can further run a full diagnostic test of the surface mud system, and communicate the results of the diagnostic test to a central operational computer.

The system can monitor LCM particulate sizes and can match the pore throat size distribution or micro-fracture sizes from original or secondary permeability. The system can detect variation in the size of the particulates used for sealing and bridging the formations while drilling. Based on the detection, the system can specify modifications to the drilling fluid (for example, periodic addition of LCMs). The system can further model particulate size distribution desired in the drilling fluid to prevent losses into the formation. The system can be implemented to mitigate, decrease or prevent issues associated with lost circulation, such as, seepage losses, differential sticking and plugging of downhole equipment. In this manner, the efficiency of drilling fluid systems can be improved, cost associated with a drilling rig fighting drilling fluid losses can be reduced and premature downhole tool plugging and failures can be mitigated, decreased or prevented.

FIG. 1 is a schematic diagram of a wellbore drilling system 100 including a lost circulation monitoring system. The wellbore drilling system 100 can be used in forming vertical, deviated or horizontal wellbores. The system 100 includes a wellbore drilling rig 112 that a drill derrick (not shown) that supports the weight of and selectively positions a drill string (not shown) in the wellbore (not shown). The drill string has a downhole end connected to a drill bit (not shown) that extends the wellbore in the geologic formation (not shown). During wellbore drilling operations, wellbore drilling fluid (also called drilling mud or mud) is circulated through the wellbore drilled by the drill bit.

For example, a wellbore drilling fluid tank 108 carries the drilling fluid. A wellbore pump 110 (or pumps) is fluidically connected to the drilling fluid tank 108 and to the drilling rig 112 through respective flow pathways (for example, piping or tubing). The pump 110 draws the drilling fluid from the drilling fluid tank 108 and flows the drilling fluid into the formation through the drill string and the drill bit, and to the surface through the annulus, as described earlier. A shaker system 114 is connected to the drilling rig 112, specifically, to the surface of the wellbore, and to the drilling fluid tank 108 through respective flow pathways. The shaker system 114 receives the drilling fluid exiting the well and removes (for example, filters) cuttings and other debris from the geologic formation. The drilling fluid is then flowed to the drilling fluid tank 108, from where the wellbore pump 110 repeats the drilling fluid circulation process.

Prior to commencing the drilling operation, the drilling fluid is loaded with particulates to serve as lost circulation material (LCM). The particulates have certain physical properties (for example, size, shape, composition, to name a few) that make the particulates suitable to prevent loss of the drilling fluid into the geologic formation and minimize differential sticking issues due to thick and poor quality filter cakes. Loss Circulation Material are used in drilling fluids applications to prevent or remediate fluid losses into formation. The materials are composed of different minerals, granular and packs of fibrous-shaped, spherical and elongated particles. Such particles can be collected from the surface or from underground mineral mines, and can include marble, gravel, sand, quartz, silica, graphite, coal, mica and other raw natural materials. They are also made from proprietary blends from paper pulp, mineral agglomerates, diatomaceous earth, cement, polymers, cellulose and organic fibers, synthetic and plastic fibers between others. Loss Circulation Materials are deformable, brittle, with some resiliency, resistant to high temperatures and bacterial attack, compatible with all drilling tools and all fluids systems (water—based and oil-based drilling fluids), with different alkalinities, specific gravities and bulk densities, sized and grinded down to match fine, medium and coarse particle sizes, and seal fractures into the formations bring drilled through. The physical properties and a concentration of the particulates in the drilling fluid are modeled to match fracture widths or pore throats. As the drilling fluid carrying the particulates is circulated through the wellbore drilling system, the concentration of the particulates decreases, in part, because the particulates enter the geologic formation and mitigate, decrease or prevent drilling fluid loss into the formation. In some instances, some of the particulates may be filtered by the shaker system 114. Over time, the drilling fluid needs to be made up, that is, the concentration of the particulates increased, so that the particulates can serve as effective LCMs.

To this end, a lost circulation monitoring system is operatively coupled to the wellbore drilling system. The monitoring system includes multiple particulate size distribution analyzers (for example, analyzer 102*a*, analyzer 102*b*, analyzer 102*c*). Each particulate size distribution analyzer can determine a size distribution of particulates in the wellbore drilling fluid circulated through the wellbore drilling system 100. Each particulate size distribution analyzer is coupled to a respective wellbore drilling fluid flow pathway (for example, flow pathway 103*a*, flow pathway 103*b*, flow pathway 103*c*). As described in detail later, each particulate size distribution analyzer can analyze particulates being carried in the drilling fluid to determine a size distribution of the particulates.

In the example implementation shown in and described with reference to FIG. 1, the first particulate size distribution analyzer 102*a* is coupled to the first flow pathway 103*a* that fluidically couples the wellbore pump 110 to the wellbore at the drilling rig 112. The second particulate size distribution analyzer 102*b* is coupled to the second flow pathway 103*b* that fluidically couples the wellbore to the shaker system 114. The third particulate size distribution analyzer 102*c* is coupled to the third flow pathway 103*c* that fluidically couples the shaker system 114 to the drilling fluid tank 108. Thus, in the example implementation shown in and described with reference to FIG. 1, three particulate size distribution analyzers are shown as being coupled to three respective flow pathways. In some implementations, more (for example, four or more) or fewer (for example, two or fewer) particulate system analyzers can be coupled to a respective number of flow pathways.

As described earlier, the LCM particulates are added to the drilling fluid tank 108 and flowed into the wellbore at the drilling rig 112. A certain quantity of the particulates can be lost during circulation through the wellbore. Thus, the concentration of the particulates in the drilling fluid that flow past the first particulate size distribution analyzer 102*a* can be less than the concentration of the particulates in the drilling fluid that flow past the second particulate size distribution analyzer 102*b*. A shaker system 114 can further remove (that is, filter) another quantity of the particulates in the drilling fluid. Thus, the concentration of the particulates in the drilling fluid that flow past the third particulate size distribution analyzer 102*c* can be less than the concentration of the particulates in the drilling fluid that flow past the second particulate size distribution analyzer 102*b*.

The lost circulation monitoring system also includes a particulates reservoir 106 which is coupled to the drilling fluid tank 108. The particulates reservoir 106 carries multiple LCM particulates of different physical properties, for example, different sizes, shapes, compositions and other physical properties. The reservoir 106 is coupled to the drilling fluid tank 108 to transfer quantities of each of the different types of the LCM particulates from the reservoir 106 into the drilling fluid tank 108. The particulates released by the reservoir 106 are mixed with the drilling fluid in the drilling fluid tank 108, thereby making up the drilling fluid to account for decreases in the concentrations of the LCM particulates in the drilling fluid.

The lost circulation monitoring system additionally includes a processing system 104 that is coupled to the multiple particulate size distribution analyzers and to the reservoir 106. In some implementations, the processing system 104 can be implemented as a computer system that includes one or more processors and a computer-readable medium storing instructions executable by the one or more processors to perform operations described in this disclosure. Alternatively or in addition, the processing system 104 can be implemented as processing circuitry, hardware, firmware or combinations of them. The processing system 104 can be operatively coupled to other components via wired or wireless data networks or combinations of them. In some implementations, the processing system 104 can receive drilling parameters identifying wellbore drilling conditions of the wellbore drilling system 100, as described later. The processing system 104 can additionally receive size distributions of the particulates in the wellbore drilling fluid from the multiple particulate size distribution analyzers. Based, in part, on the received drilling parameters and the received size distributions of the particulates, the processing system 104 can control the reservoir 106 to release certain particulates into the drilling fluid tank 108 to make up the drilling fluid.

Figure 2:
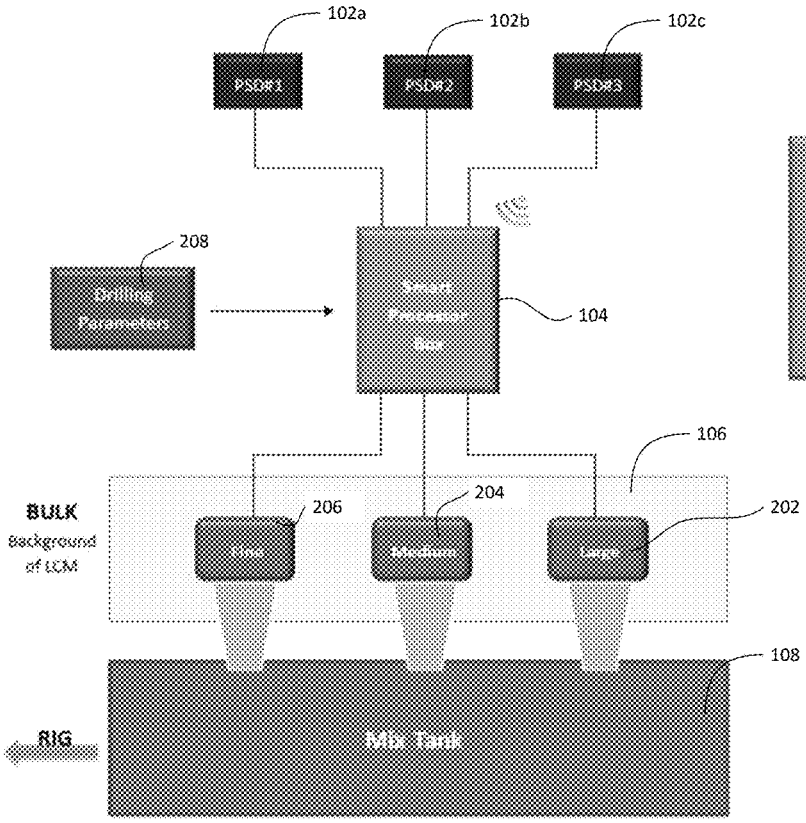
FIG. 2 is a schematic diagram of the lost circulation monitoring system controlling LCM composition of the drilling fluids.

FIG. 2 is a schematic diagram of the lost circulation monitoring system controlling LCM composition of the drilling fluids. As described earlier, each particulate size distribution analyzer (for example, the first analyzer 102*a*, the second analyzer 102*b*, the third analyzer 102*c*) is coupled to a respective fluid flow pathway (for example, the first pathway 103*a*, the second pathway 103*b*, the third pathway 103*c*). A particulate size distribution analyzer can implement laser diffraction in a range between 0.001 micrometers to 3500 micrometers to evaluate wet particles, dry particles, and wet and dry particles. Such analyzers are offered by Malvern Instruments, Inc. (Massachusetts, USA). The analyzers are interchangeable, that is, an analyzer implemented in one flow pathway can be replaced by another analyzer implemented in another flow pathway. In some implementations, only one analyzer can be used. For example, the same analyzer can be used to measure the particulate size distribution in different flow pathways.

Each particulate size distribution analyzer can measure particulate size distribution in the range of 1 micrometer to 2,000 micrometers. The nature of the particulates used in drilling fluids generally depends upon physical properties of the source material, for example, the material's origin, its specific gravity and the milling process used to form the particulates. Based on size distributions, particulates are termed as D10 (meaning that 90% of the particulates are larger than 1 micrometer and 10% are smaller than 1 micrometer), D50 (meaning that 50% of the particulates are bigger than 10 micrometers and 50% are smaller than 10 micrometers) and D90 (meaning that 10% of the particulates are bigger than 100 micrometer and 90% are smaller than 100 micrometer). Each particulate size distribution analyzer can implement laser diffraction on wet particulates while drilling to determine the size distribution. In some implementations, a Particle Size Distribution analyzer is an equipment that uses Laser diffraction to read all particle sizes on a given sample. That sample is removed from the flow path way, collected and analyzed and data is reported as a frequency by reporting the full probabilistic distribution D10 (90% of the particles above this size in microns), D50 (50% of the particles above this size and 50% below this size in microns) and D90 (10% of the particles above this size in microns). In some implementations, PSD readings can be provided every 10 minutes. In general, each analyzer can measure the size of any particle in the drilling fluid including, for example, cuttings carried by the drilling fluid from the geologic formation to the surface of the wellbore.

Figure 3:
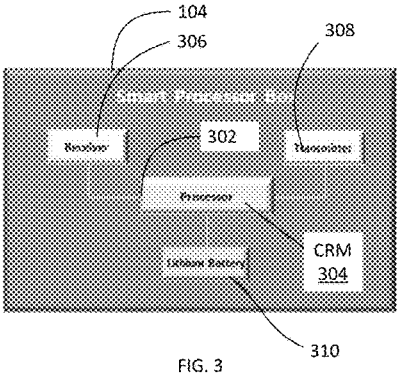
FIG. 3 is a schematic diagram of a processing system of the lost circulation monitoring system.

FIG. 3 is a schematic diagram of the processing system 104 of the lost circulation monitoring system. The processing system 104 includes one or more processors (for example, processor 302) and a computer-readable medium 304 storing instructions executable by the one or more processors to perform the operations described here. The processing system 104 can be positioned at the site of the wellbore drilling system 100 (for example, at the rig site on the surface) or can be positioned at a location that is remote from the wellbore drilling system. Alternatively, or in addition, the processing system 104 can be implemented as a distributed computing system that is disposed in-part at the rig site and in-part at the remote location. The processing system 104 can include a receiver 306 and a transmitter 308 to receive signals from and transmit signals to different components of the wellbore drilling system 100. For example, the receiver 306 can receive the drilling parameters 208 from the multiple sensors. The transmitter 308 can transmit instructions to the reservoir 106 or transmit LCM particulate concentrations, for example, as outputs to a display device or another computer system, over wired or wireless networks. The processing system 104 can include a power source 310 (for example, a battery) to provide uninterrupted power supply to the processing system 104. Alternatively, or in addition, solar power sources, turbines or generator (not shown) can be coupled to the processing system 104 to provide power using long periods of blackout.

As described earlier, the processing system 104 receives particulate size distributions measured by each particulate size distribution analyzer. Also, as described earlier, the processing system 104 receives drilling parameters 208. In some implementations, the drilling parameters can be received from multiple sensors (not shown), each measuring one or more drilling parameters. For example, the sensors can measure a rate of penetration of the drill bit, a flow rate of the drilling fluid through the wellbore drilling system 100, rate of drilling fluid loss, to name a few. Additional drilling parameters that can be measured by one or more additional sensors can include, for example, percentage of cuttings coming out of the shaker system 114 and LCM background concentration.

The processing system 104 can store (for example, in the computer-readable medium 304) one or more rheology models that identify a desired viscosity value for the drilling fluid and concentrations of particulates that need to be added to the drilling fluid tank 108 to achieve this concentration. In general, the rheology models can predict and estimate based on density, drilling fluid rheology, solids content, temperature and funnel viscosity, a solids background by using pre-loaded data from previous intervals drilled. For example, the rheology models can include an initial physical properties of the particulates in the drilling fluid such as concentration, size distribution, to name a few. Using the drilling parameters 208 received from the sensors and the particulate size distribution received from the particulate size distribution analyzers, the processing system 104 can determine a change in the physical properties of the drilling fluid that has been circulated through the wellbore drilling system 100. For example, based on the drilling fluid flow rate and the size distribution of particulates, the processing system 104 can determine that a concentration of the particulates has decreased from an initial concentration. In response, the processing system 104 can determine a quantity of the particulates to be added to the drilling fluid to make up the lost concentration. In addition, the processing system 104 can identify different particulate types (for example, D10, D50 or D90) and the quantity of each particulate type to be added to the drilling fluid.

Certain equations and algorithms that the processing system 104 can store and execute to implement the techniques described in this disclosure are described here.

Description of Variables

D10=Probabilistic Distribution (90% of particles above this size, microns)

D50=Probabilistic Distribution, median (50% of particles above this size & 50% below this size, microns)

D90=Probabilistic Distribution, (10% of particles above this size, microns)

XD10=X product D10

XD50=X product D50

XD90=X product D90

YD10=Y product D10

YD50=Y product D50

YD90=Y product D90

ZD10=Z product D10

ZD50=Z product D50

ZD90=Z product D90

XYZD10=D10 of the mix XYZ

XYZD50=D50 of the mix XYZ

XYZD90=D90 of the mix XYZ

Concentration=Mass/volume, pounds per barrel (ppb)

Xppb=Concentration of X product, ppb

Yppb=Concentration of Y product, ppb

Zppb=Concentration of Z product, ppb

XYZppb: Total concentration of the mix, ppb

% Xppb=% by concentration: Fraction of X product in the total mix XYZppb

% Yppb=% by concentration: Fraction of Y product in the total mix XYZppb

Zppb=% by concentration: Fraction of Z product in the total mix XYZppb

Rules

Formation Pore throat or micro-fracture aperture=FD10, FD50, FD90 (from thin section analysis, permeability data or SEM).

FD10 should be same than XYZD10 for perfect match, but not less. If it is, need to compensate by modifying addition of Xppb, Y, ppb or Zppb (Use Delta formula below).

FD50 should be same than XYZD50 for perfect match, but not less. If it is, need to compensate by modifying addition of Xppb, Y, ppb or Zppb (Use Delta formula below).

FD90 should be same XYZD90 for perfect match, but not less. If it is, need to compensate by modifying addition of Xppb, Y, ppb or Zppb (Use Delta formula below).

% Xppb+% Yppb+% Zppb must be equal to 100%

Considerations for Optimization

DeltaXYZD10: Modification required to fill the gap between XYZD10 and FD10.

DeltaXYZD50: Modification required to fill the gap between XYZD50 and FD50.

DeltaXYZD90: Modification required to fill the gap between XYZD90 and FD90.

Equations $$XD10*\%Xppb+YD10*\%Yppb+ZD10*\%Zppb=XYZD10$$

$$XD50*\%Xppb+YD50*\%Yppb+ZD50*\%Zppb=XYZD50$$

$$XD90*\%Xppb+YD90*\%Yppb+ZD90*\%Zppb=XYZD90$$

$$Xppb=\%Xppb*XYZppb$$

$$Yppb=\%Yppb*XYZppb$$

$$Zppb=\%Zppb*XYZppb$$

Subzero=Initial values

Sub1=Reading at a given moment $$DeltaXYZD10=XYZD10_1-XYZD10_0$$

$$DeltaXYZD50=XYZD50_1-XYZD50_0$$

$$DeltaXYZD90=XYZD90_1-XYZD90_0$$

Other Variables After Optimization and Getting Data

Attrition degree: Disintegration of the particle with the time due to flow conditions while drilling. Processing system will be able to plot, anticipate and predict attrition degree at a given rate of penetration and flow rate while drilling and adjust hourly additions automatically, as a correction factor in the calculations after some time of implementation.

A10, A50, A90=Contingency value to correct modifications (Delta values) and it is represented as a fraction.

$$A\text{Delta}XYZD10=\text{Delta}XYZD10/A10$$

$$A\text{Delta}XYZD50=\text{Delta}XYZD50/A50$$

$$A\text{Delta}XYZD90=\text{Delta}XYZD90/A90$$

In the implementation described earlier, the processing system 104 determined the quantity of each particulate in response to and based, in part, on the drilling parameters and the particulate size distributions received from the analyzers. In some implementations, the processing system 104 can predictively determine the quantity of each particulate without relying on the drilling parameters or the particulate size distributions received from the analyzers. To do so, initially, the processing system 104 can determine and store different quantities of particulates to be added to the drilling fluid over time. For example, for an initial duration, the processing system 104 can periodically (for example, once every minute, once every 2 to 3 minutes or more frequently than once every minute) receive drilling parameters and particulate size distributions. The processing system 104 can store the received information, for example, in the computer-readable medium 304. Using the received information, the processing system 104 can determine multiple quantities of particulates to add to the drilling fluid and store the multiple quantities, for example, in the computer-readable medium 304. Over time and by executing statistical operations, the processing system 104 can develop a history of particulate concentrations added to the drilling fluid based on a history of drilling conditions and particulate size distributions. Subsequently, the processing system 104 can use the history and, without requiring additional drilling parameters or particulate size distributions, determine quantities of particulates needed to make-up the drilling fluid.

In the example implementation described earlier, the processing system 104 received drilling parameters and particulate size distributions periodically. In some implementations, the processing system 104 can receive and process the information in real-time. By real-time, it is meant that a duration to receive successive inputs or a duration to process a received input and produce an output is less than 1 milli-second or 1 nano-second depending on the specifications of the processor 302. In some implementations, the processing system 104 can process the information in real-time and periodically provide outputs of processing the information at a different frequency. For example, the processing system 104 can provide instructions to add particulates to the drilling fluid tank 108, for example, once every minute, once every 2 to 3 minutes or more frequently than once every minute. Alternatively or in addition, the processing system 104 can provide the concentrations of the particulates in the drilling fluid as outputs periodically (for example, in real-time or otherwise), for example, for display in a display device or transmission to a remote computer system. The outputs can provide a diagnostic of the losses experienced during the wellbore drilling operation.

Returning to FIG. 2, the processing system 104 is operatively coupled to the particulates reservoir 106, which can include multiple reservoirs, each containing particulates of a different size distribution. For example, the multiple reservoirs can include a fine particulates reservoir 206 containing particulates of a first size distribution (for example, D50 of approximately 5-7 microns), a medium particulates reservoir 204 containing particulates of a second size distribution greater than the first size distribution (for example, D50 of approximately 100-130 microns) and a coarse particulates reservoir 202 containing particulates of a third size distribution greater than the second size distribution (for example, D50 of approximately 500 microns). Each particulate reservoir is connected to the drilling tank 108 such that particulates released from the reservoir flow into the drilling tank 108 to be mixed with the drilling fluid. In some implementations, each particulate reservoir can include a valve that can be actuated (for example, opened or closed) in response to a signal from the processing system 104. Depending on the physical properties of each particulate type in each particulate reservoir (for example, weight, density, volume or other physical properties), the processing system 104 can actuate the valve for a duration sufficient to release a determined quantity of particulates into the drilling fluid tank 108. By opening or closing the valves of each tank for appropriate durations, the processing system 104 can add necessary quantities of particulates of different types to make-up the drilling fluid to a level sufficient to mitigate, decrease or prevent lost circulation during wellbore drilling.

Air compressors will be connected to each reservoir. These compressors will be coupled with lines from the reservoirs to the mix tank 108. The processor box will emit a signal that will activate the air compressor depending on the data processed and the need of each particulate from each reservoir. The processor box will emit another signal to stop the compressor(s) once PSD #1 (102*a*) is satisfied. In addition and in some cases, each reservoir will contain weighting systems to determine the exact quantity of the particulates on each reservoir and the need to refill.

Figure 4:
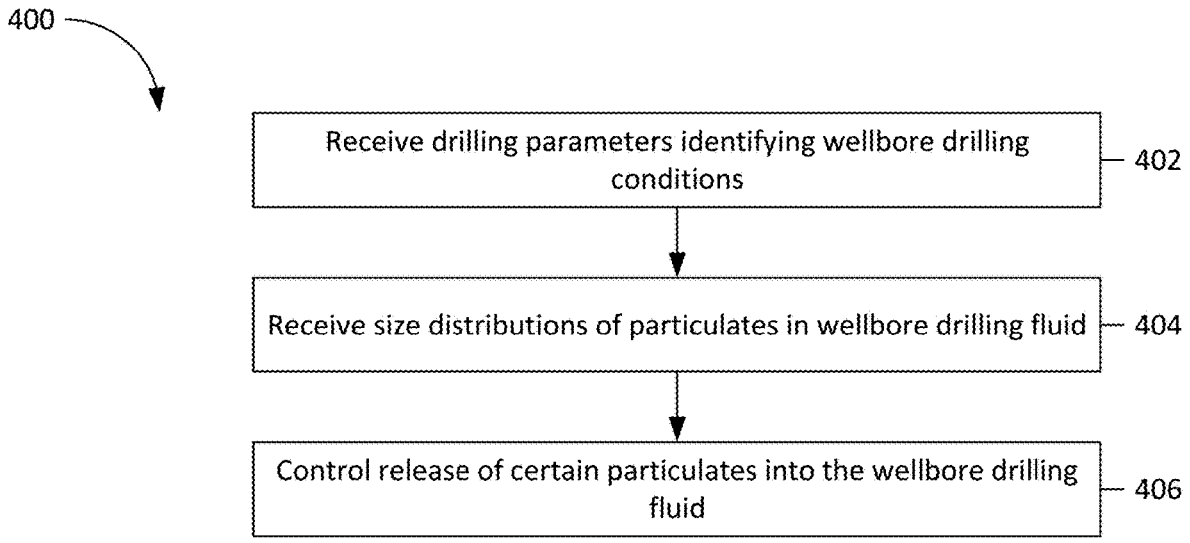
FIG. 4 is a flowchart of an example process of controlling LCM composition of drilling fluids while drilling a wellbore.

FIG. 4 is a flowchart of an example process 400 of controlling LCM composition of drilling fluids while drilling a wellbore. The process 400 can be implemented by the processing system 104 while wellbore drilling operations in a geologic formation are ongoing. At 402, drilling parameters identifying wellbore drilling conditions of a wellbore drilling system drilling the wellbore are received. For example, the processing system 104 can receive the drilling parameters measured by multiple sensors disposed at different locations in the wellbore drilling system 100 (including, for example, at the surface of or within the wellbore). At 404, size distributions of the particulates in the wellbore drilling fluid flowing through multiple, different wellbore drilling fluid flow pathways can be received. For example, the processing system 104 can receive the particulate size distributions from the particulate size distribution analyzers as described earlier. At 406, a release of certain particulates into the wellbore drilling fluid can be controlled based, in part, on the received drilling parameters and the received size distributions of the particulates. For example, the processing system 104 can transmit instructions to the particulates reservoir 106 to release certain quantities of the particulates into the drilling fluid tank 108. Based on the received drilling parameters and the received size distributions of the particulates, the processing system 104 can have determined that the quantities to be released can make up the loss of LCM particulates in the drilling fluid.

While this specification contains many specific implementation details, these should not be construed as limitations on the scope of what may be claimed, but rather as descriptions of features specific to particular implementations of particular systems or methods. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of implementations have been described. Nevertheless, it will be understood that various modifications may be made without departing from the spirit and scope of the disclosure. For example, although the system is described as being wireless, it can include wired communication between at least parts of the system. Accordingly, other implementations are within the scope of the following claims.

The invention claimed is:

1. A wellbore drilling system comprising:

a plurality of particulate size distribution analyzers, each particulate size distribution analyzer configured to determine a size distribution of particulates in a wellbore drilling fluid circulated through the wellbore drilling system, each particulate size distribution analyzer coupled to a respective wellbore drilling fluid flow pathway, the particulates comprising lost circulation material (LCM) configured to reduce loss of the wellbore drilling fluid into a geologic formation in which the wellbore is being drilled;

a particulates reservoir coupled to the plurality of particulate size distribution analyzers, the particulates reservoir configured to carry particulates of different physical properties, the particulates reservoir configured to release certain particulates into a drilling fluid tank of the wellbore drilling system to be mixed with the wellbore drilling fluid circulated through the drilling fluid tank; and a processing system coupled to the plurality of particulate size distribution analyzers and to the particulates reservoir, the processing system configured to perform operations while drilling the wellbore, the operations comprising:

receiving drilling parameters identifying wellbore drilling conditions of the wellbore drilling system;

receiving size distributions of particulates in the wellbore drilling fluid from the plurality of particulate size distribution analyzers;

controlling the particulates reservoir to release the certain particulates into the drilling fluid tank based, in part, on the received drilling parameters, the received size distributions of the particulates, and determining a first quantity of particulates to be added;

developing a history of particulate concentrations added to the drilling fluid based on a history of drilling conditions and particulate size distributions; and determining second quantities of particulates needed to make-up the drilling fluid responsive, in part, to the developed history for a subsequent drilling operation.

2. The wellbore drilling system of claim 1, wherein the operations further comprise determining, based on the received drilling parameters and the received size distributions of the particulates, a third quantity of the particulates to be added to the wellbore drilling fluid to increase a concentration of the particulates to a level sufficient to reduce the loss of the wellbore drilling fluid into a geologic formation in which the wellbore is being drilled.

3. The system of claim 1, wherein the plurality of particulate size distribution analyzers comprises:

a first particulate size distribution analyzer coupled to a first wellbore drilling fluid flow pathway between a drilling fluid pump and a drilling rig;

a second particulate size distribution analyzer coupled to a second wellbore drilling fluid flow pathway between the drilling rig and a shaker system; and a third particulate size distribution analyzer coupled to a third wellbore drilling fluid flow pathway between the shaker system and the drilling fluid tank.

4. The system of claim 1, wherein the particulates reservoir comprises:

a fine particulates reservoir containing particulates of a first size distribution, the fine particulates reservoir coupled to the drilling fluid tank, the fine particulates reservoir configured to release a quantity of the particulates of the first size distribution into the drilling fluid tank in response to a first controlling signal from the processing system;

a medium particulates reservoir containing particulates of a second size distribution greater than the first size distribution, the medium particulates reservoir coupled to the drilling fluid tank, the medium particulates reservoir configured to release a quantity of the particulates of the second size distribution into the drilling fluid tank in response to a second controlling signal from the processing system; and a coarse particulates reservoir containing particulates of a third size distribution greater than the second size distribution, the coarse particulates reservoir coupled to the drilling fluid tank, the coarse particulates reservoir configured to release a quantity of the particulates of the third size distribution into the drilling fluid tank in response to a third controlling signal from the processing system.

5. The system of claim 1, wherein each particulate size distribution analyzer is configured to determine the size distribution of particulates in the wellbore drilling fluid circulated through the respective wellbore drilling fluid flow pathway during wellbore drilling.

6. The system of claim 1, wherein the drilling parameters include a rate of penetration of a drill bit, a flow rate of the wellbore drilling fluid through the wellbore, and a rate of loss of the wellbore drilling fluid in the geologic formation in which the wellbore is being drilled.

7. The system of claim 1, wherein the processing system is configured to perform operations comprising periodically providing, as outputs, concentrations of the particulates in the wellbore drilling fluid during wellbore drilling operations.

8. The system of claim 1, wherein the different physical properties of the particulates comprise a particulate size ranging between 1 micrometer and 2,000 micrometers.

9. A method comprising:

while a wellbore is being drilled in a geologic formation, receiving drilling parameters identifying wellbore drilling conditions of a wellbore drilling system drilling the wellbore;

flowing a wellbore drilling fluid comprising particulates of different size distributions, the particulates operating as lost circulation material (LCM) to reduce loss of the wellbore drilling fluid in the geologic formation;

receiving size distributions of the particulates in the wellbore drilling fluid flowing through a plurality of different wellbore drilling fluid flow pathways of the wellbore drilling system, the size distributions representing a concentration of the particulates in the wellbore drilling fluid;

controlling a release of certain particulates into the wellbore drilling fluid based, in part, on the received drilling parameters, the received size distributions of the particulates, and determining a first quantity of particulates to be added;

developing a history of particulate concentrations added to the drilling fluid based on a history of drilling conditions and particulate size distributions; and determining second quantities of particulates needed to make-up the drilling fluid responsive, in part, to the developed history, for a subsequent drilling operation.

10. The method of claim 9 further comprising determining, based on the received drilling parameters and the received size distributions of the particulates, a third quantity of the particulates to be added to the wellbore drilling fluid to increase the concentration of the particulates to a level sufficient to reduce the loss of the wellbore drilling fluid into a geologic formation in which the wellbore is being drilled.

11. The method of claim 9, wherein the drilling parameters include a rate of penetration of a drill bit, a flow rate of the wellbore drilling fluid through the wellbore, and a rate of loss of the wellbore drilling fluid in the geologic formation in which the wellbore is being drilled.

12. The method of claim 9, further comprising periodically providing, as outputs, concentrations of the particulates in the wellbore drilling fluid during wellbore drilling operations.

13. The method of claim 9, wherein a particulates reservoir carries particulates of different physical properties comprising a particulate size ranging between 1 micrometer and 2,000 micrometers.

14. The method of claim 9, wherein the certain particulates comprise one or more of particulates of a first size distribution, particulates of a second size distribution greater than the first size distribution, and particulates of a third size distribution greater than the second size distribution.

15. A wellbore drilling system comprising:

a drilling fluid tank configured to carry wellbore drilling fluid;

a wellbore pump configured to pump the wellbore drilling fluid during a wellbore drilling operation;

a wellbore drilling rig configured to support wellbore drilling equipment configured to drill the wellbore in a geologic formation during the wellbore drilling operation;

a shaker system configured to remove cuttings carried by the wellbore drilling fluid during the wellbore drilling operation;

a plurality of particulate size distribution analyzers, each particulate size distribution analyzer configured to determine a size distribution of particulates in a wellbore drilling fluid circulated through the wellbore drilling system, each particulate size distribution analyzer coupled to a respective wellbore drilling fluid flow pathway through which the wellbore drilling fluid is flowed, the particulates comprising lost circulation material (LCM) configured to reduce loss of the wellbore drilling fluid into the geologic formation in which the wellbore is being drilled; and a processing system coupled to the plurality of particulate size distribution analyzers, the processing system configured to perform operations while drilling the wellbore, the operations comprising:

receiving drilling parameters identifying wellbore drilling conditions of the wellbore drilling system;

receiving size distributions of particulates in the wellbore drilling fluid from the plurality of particulate size distribution analyzers;

releasing certain particulates into the drilling fluid tank based, in part, on the received drilling parameters, the received size distributions of the particulates, and determining a first quantity of certain particulates to be added;

developing a history of particulate concentrations added to the drilling fluid based on a history of drilling conditions and particulate size distributions; and determining second quantities of particulates needed to make-up the drilling fluid responsive, in part, to the developed history, for a subsequent drilling operation.

16. The well drilling system of claim 15, wherein the operations further comprise determining, based on the received drilling parameters and the received size distributions of the particulates, a third quantity of certain particulates to be added to the wellbore drilling fluid to increase a concentration of the certain particulates to a level sufficient to reduce the loss of the wellbore drilling fluid into a geologic formation in which the wellbore is being drilled.

17. The system of claim 15, wherein the plurality of particulate size distribution analyzers comprises:

a first particulate size distribution analyzer coupled to a first wellbore drilling fluid flow pathway between a drilling fluid pump and a drilling rig;

a second particulate size distribution analyzer coupled to a second wellbore drilling fluid flow pathway between the drilling rig and a shaker system; and a third particulate size distribution analyzer coupled to a third wellbore drilling fluid flow pathway between the shaker system and the drilling fluid tank.

18. The system of claim 15, further comprising a particulates reservoir comprising:

a fine particulates reservoir containing particulates of a first size distribution, the fine particulates reservoir coupled to the drilling fluid tank, the fine particulates reservoir configured to release a quantity of the particulates of the first size distribution into the drilling fluid tank in response to a first controlling signal from the processing system;

a medium particulates reservoir containing particulates of a second size distribution greater than the first size distribution, the medium particulates reservoir coupled to the drilling fluid tank, the medium particulates reservoir configured to release a quantity of the particulates of the second size distribution into the drilling fluid tank in response to a second controlling signal from the processing system; and a coarse particulates reservoir containing particulates of a third size distribution greater than the second size distribution, the coarse particulates reservoir coupled to the drilling fluid tank, the coarse particulates reservoir configured to release a quantity of the particulates of the third size distribution into the drilling fluid tank in response to a third controlling signal from the processing system.

19. The system of claim 18, wherein each particulate size distribution analyzer is configured to determine the size distribution of particulates in the wellbore drilling fluid circulated through the respective wellbore drilling fluid flow pathway during wellbore drilling.

20. The system of claim 18, wherein the drilling parameters include a rate of penetration of a drill bit, a flow rate of the wellbore drilling fluid through the wellbore, and a rate of loss of the wellbore drilling fluid in the geologic formation in which the wellbore is being drilled.

* * * * *